United States Patent [19]

Lattion

[11] 3,942,731

[45] Mar. 9, 1976

[54] METHOD AND APPARATUS FOR FORMING RESERVE WINDINGS DURING A BOBBIN CHANGE ON A SPINNING MACHINE

[75] Inventor: Andre Lattion, Winterthur, Switzerland

[73] Assignee: Rieter Machine Works, Ltd., Winterthur, Switzerland

[22] Filed: Oct. 21, 1974

[21] Appl. No.: 516,576

Related U.S. Application Data

[63] Continuation-in-part of Ser. No. 376,282, July 5, 1973, abandoned.

[30] Foreign Application Priority Data

July 6, 1972 Switzerland ..... 10164/72
Dec. 17, 1973 Switzerland ..... 17624/73

[52] U.S. Cl. ..... 242/18 PW; 242/18 A; 242/19; 242/35.5 A

[51] Int. Cl.[2] ..... B65H 54/02; B65H 67/04

[58] Field of Search ..... 242/18 PW, 18 A, 18 DD, 242/129.51, 35.5 A, 19

[56] References Cited

UNITED STATES PATENTS

| | | | |
|---|---|---|---|
| 3,282,516 | 11/1966 | Porter | 242/18 PW |
| 3,411,726 | 11/1968 | Engleman et al. | 242/18 PW |
| 3,429,514 | 2/1969 | Pospisil et al. | 242/18 A |
| 3,507,453 | 4/1970 | Scragg et al. | 242/18 A |
| 3,512,726 | 5/1970 | Kaiser | 242/129.51 X |
| 3,572,597 | 3/1971 | Parker et al. | 242/18 A |
| 3,682,403 | 8/1972 | Willis | 242/18 A |
| 3,717,310 | 2/1973 | Ritter | 242/18 A |
| 3,741,490 | 6/1973 | Venot | 242/18 A |

*Primary Examiner*—Stanley N. Gilreath
*Attorney, Agent, or Firm*—Kenyon & Kenyon Reilly Carr & Chapin

[57] ABSTRACT

A suction means and a severing means are located behind the friction drive drum to receive a yarn when the bobbin holder is lifted into a idling position and to sever the yarn when the holder is returned to the operating position with a fresh tube in place. The suction means and severing means are actuated via the holder and are positioned to one end of the fresh tube so that the short yarn end can be wound onto the tube in a reserve winding zone. The yarn is thereafter moved into the usual yarn traversing zone of the tube to form a bobbin.

25 Claims, 12 Drawing Figures

Fig. 1

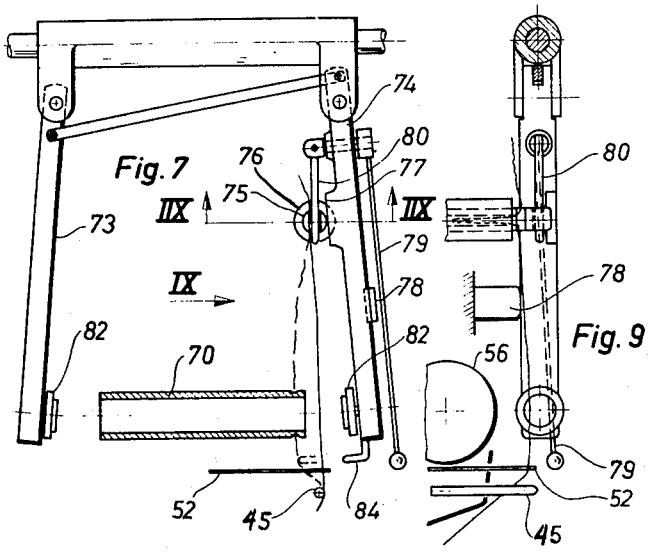
Fig. 7
Fig. 9
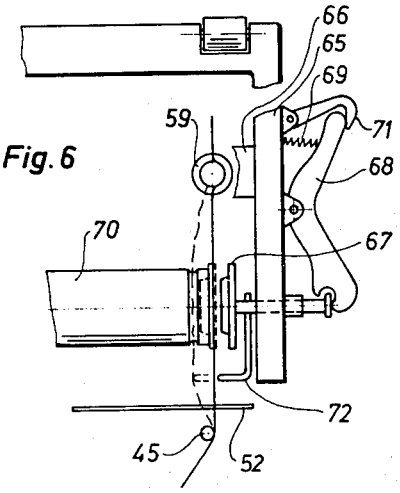
Fig. 6
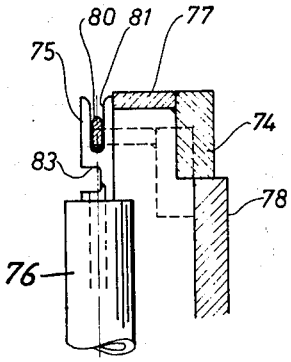
Fig. 8

METHOD AND APPARATUS FOR FORMING RESERVE WINDINGS DURING A BOBBIN CHANGE ON A SPINNING MACHINE

This is a continuation-in-part of copending U.S. patent application Ser. No. 376,282 filed July 5, 1973, now abandoned.

This invention relates to a method of forming reserve windings during the bobbin change on a spinning machine and an apparatus for implementing the method.

Open end spinning machines have been known in which a yarn is spun in a spinning unit, continuously taken off by take-off rolls and taken up on a bobbin disposed above and in contact with a drive drum. Heretofore, in order to carry out a bobbin change in such a machine, a holder or frame on which the full bobbin is mounted has been pivoted upwardly from the drive drum and the full bobbin removed, i.e. doffed, while the yarn which is still supplied has been severed by hand.

In order to free the hands of the operator for donning a fresh empty tube, the bobbin has been deposited on the machine or any other place and the free yarn end being delivered from the take-off rolls continuously and without interruption is taken off a traversing device for winding of the yarn across the bobbin and is placed into a suction device usually arranged between the take-off rolls and the winding position. Thereafter, the empty tube has been placed in the holder. Next, the holder has been lowered, i.e. brought into contact with the friction drive drum and the yarn end has been thrown onto the tube in any manner; the thread sticking to the tube owing to the adhesive properties of the tube. Then, the yarn is replaced in the traversing device and the build-up of the new bobbin started.

Since these operations have been performed manually, it has been proposed to automate the operations to effect a more economical operation. For example, it has been proposed to lift off the full bobbin automatically, to detach the bobbin from the holder and to drop and guide the bobbin onto a transporting belt, whereupon a fresh empty tube is automatically supplied from a tube storage and placed into the bobbin holder which is then brought into the operating position. The piece of yarn of a certain length extending from between the friction drive drum and the freshly placed tube on one hand and the dropped full bobbin on the other hand would be thrown in loop form by means of a blowing nozzle, without severing the yarn, onto the empty tube. The tube would then be driven so that the winding process is started and the yarn extending to the full bobbin necessarily torn off.

However, the manual as well as the fully automatic bobbin change process described above have the severe disadvantage that a formation of reserve windings is not possible, i.e. the inner yarn end of the bobbin is covered up and cannot be reached on the complete full bobbin. Furthermore, the fully automatic device is very complicated and expensive, as control elements and timing relays which must be adapted to the operating conditions each time (yarn count, delivery speed, etc.,) cannot be eliminated.

Accordingly, it is an object of the invention to form a yarn reserve on a bobbin in an automated manner.

It is another object of the invention to form reserve windings during a bobbin change while making use of the operationally less-loaded time periods of the operators and without incurring stoppages of operation or undesireable waste materials.

It is another object of the invention to form reserve windings in a simple manner so that the free yarn end is not covered over by the bobbin build windings.

It is another object of the invention to avoid disturbances during subsequent processing of bobbin wound yarns by unsuccessful attempts to free a covered yarn end.

It is another object of the invention to sever a yarn between a full bobbin and the reserve windings on a fresh bobbin reliably and neatly even at low yarn tension.

It is another object of the invention to reduce the risk of accidents to operating personnel on spinning machines.

It is another object of the invention to use a minimum of energy in effecting a yarn reserve during a bobbin change.

It is another object of the invention to create conditions under which, during a bobbin change on a staple fiber spinning machine, a yarn delivered by the spinning machine is sucked off in a simple manner by a suction device and the yarn delivered by the spinning machine after piecing-up on a new bobbin tube is severed reliably between the bobbin tube and the suction device, independently of the yarn count spun and of the fiber material processed.

Briefly, the invention provides a method and apparatus for forming reserve windings during a bobbin change on a spinning machine which allows for an automated operation.

The method includes the steps of initially lifting the wound bobbin from an operating position adjacent a friction drive drum to an idling position while continuously supplying yarn, e.g. from a spinning device, of displacing the yarn transversely, i.e. laterally, of the wound bobbin into a reserve winding path, of holding the yarn under a suction force while doffing the wound bobbin and donning a fresh empty tube, and of lowering the tube into the operating position while severing the held yarn immediately downstream of the tube relative to the supplied yarn shortly before or while the tube makes contact with the drive drum to form a short yarn end. The short yarn end is then automatically taken up on the tube in the reserve winding zone to form a plurality of reserve windings. Thereafter, the yarn is moved into the winding zone of the tube to build a bobbin.

The apparatus includes a holder for removably receiving a tube for winding of a bobbin thereon with the holder being pivotally mounted between an operating position and an idling position above said operating position, a friction drive drum mounted adjacent the operating position for driving the tube, a spinning device for supplying a yarn between said friction drive drum and said holder, a yarn suction means for holding a yarn and a yarn severing means for severing a yarn. The yarn suction means is positioned downstream of the friction drive drum relative to the supplied yarn for holding the yarn under suction. In addition, the suction means is positioned below the holder for actuation thereby upon movement of the holder towards the operating position in order to stop the suction of the suction means. The yarn severing means is also positioned downstream of the friction drive drum relative to the supplied yarn to sever a yarn held in the yarn suction means in order to produce a short yarn end.

The yarn severing means is also positioned below the holder for actuation thereby upon movement of the holder towards the operating position.

The tube for taking up the regular bobbin package windings and the laterally arranged reserve windings is driven by friction while in contact with the friction drive drum so that the windings are formed while the yarn is traversed across the tube, e.g. by a yarn traversing means. A means is also provided for taking up and holding the yarn end delivered by a spinning device on the newly placed tube.

The yarn suction means and a yarn severing means are each mounted in close proximity behind the friction drive drum and approximately in the zone of the means for holding the yarn end on the tube. The suction means and severing means are arranged so that the holder upon being pivoted down activates the closing of the cutting means and the stopping of the suction of the suction means shortly before reaching the operating position.

In one embodiment, the bobbin holder is lifted manually and the yarn is introduced to the suction means. After doffing of the bobbin and donning of a fresh tube, the holder is lowered manually. The yarn is then severed and the reserve windings formed automatically. The return of the yarn to the traversing means is carried out manually.

In another embodiment, the yarn can be lifted off the traversing device and moved to the reserve winding zone automatically when the bobbin holder is lifted. The yarn can also be returned automatically to the traversing device as the bobbin holder is lowered.

In these embodiments, the tube can have an adhesive in the reserve windings zone to catch and hold the yarn end for winding purposes. Alternatively, the tube can cooperate with a clamping means on the holder so that the yarn end is initially clamped between the holder and one end of the tube prior to lowering of the holder. In this case, the holder has a guide means for directing a portion of the yarn to move into the reserve winding zone when the tube is secured in place.

In still another embodiment, instead of using a severing means, a clamping means is adjoined to the pivotal bobbin holder to clamp and hold the yarn between a suction means and the bobbin tube during the time of downward pivoting of the bobbin holder with a fresh tube to the operating position. Once the yarn begins to be wound into the reserve windings, the increase in tension serves to rupture the yarn between the clamping means and the tube. Thereafter, as the holder pivots upwardly under the force of the accumulated windings of the bobbin package, the severed yarn is released from the clamping means and sucked off.

These and other objects and advantages of the invention will become more apparent from the following detailed description and appended claims taken in conjunction with the accompanying drawings in which:

FIG. 6 illustrates a view of another alternative construction of part of the apparatus of the invention;

FIG. 7 illustrates a top view of a modified bobbin holder according to the invention;

FIG. 8 illustrates a view taken along line VIII—VIII of FIG. 7;

FIG. 9 illustrates a view of the bobbin holder as seen in the direction IX indicated in FIG. 7;

Figures 1, 2, 3, 4:
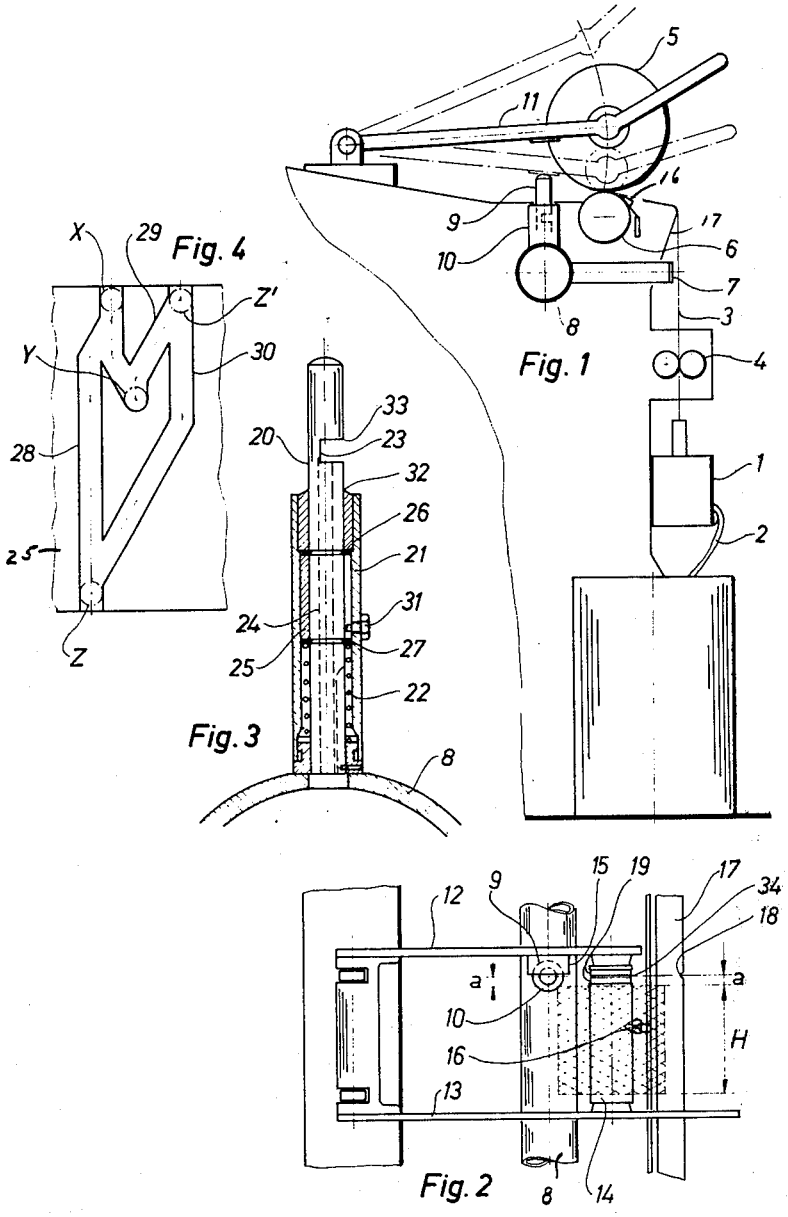
FIG. 1 illustrates a schematic side view of an open end spinning machine having an apparatus according to the invention.
FIG. 2 illustrates a top view of the apparatus of FIG. 1.
FIG. 3 illustrates a cross-sectional view of a suction means and a cutting means according to the invention.
FIG. 4 illustrates a switching sleeve in the developed state for controlling the movements of the suction means and cutting means.

Referring to FIG. 1, the spinning machine includes an open end spinning device 1 which receives a staple fiber sliver 2 from a known source and forms the sliver 2 into a twisted yarn 3. The yarn 3 is then removed by a pair of takeoff rolls 4 and wound onto a bobbin 5. The bobbin 5 is disposed in an operating position and is frictionally driven by a friction drive drum 6. A suction nozzle 7, known per se, is provided above the take-off rolls 4 to take up the yarn e.g. in case of an end breakage, and is connected to an exhaust duct 8 extending along the inside of the machine. A second connectable suction means 9 also extends from the exhaust duct 8 and is combined with a thread cutting means 10. The bobbin 5 is held laterally by a two-armed holder 11, the arms 12 and 13 (FIG. 2) of which tend towards each other in spring-like fashion and are moved away from each other, in any suitable manner, for doffing a full bobbin or for donning a fresh bobbin tube 14.

The yarn suction and cutting means 9, 10 are arranged as close as possible to the vicinity of the friction drive drum 6 or the tube 14 in its operating position respectively, as well as to the vicinity of the vertical pivoting plane of the holder arm 12. A plate 15 is mounted on the arm 12 in the region of the yarn suction means to act as a cam for activating the yarn suction and cutting means 9, 10. Also, a thread guide 16 is positioned in front of the friction drive drum 6 to traverse across a yarn winding zone H and a guide plate 17 is arranged upstream of the thread guide 16. This guide plate 17 is provided with a notch 18 at a distance *a* outside the winding zone H into which the yarn can be placed. The notch 18 and the centerlines of the suction and cutting means 9, 10 are arranged at about the saem lateral distance *a* from the winding zone H.

The bobbin tube 14 placed into the holder 11 is provided with an adhesive reserve winding zone 19 spaced laterally at the same distance *a*, as above, from the yarn winding zone H. The reserve winding zone 19 can be provided in the form of a roughed surface, a flocked surface or in the form of a circumferential recess with notches which during the bobbin change take up and hold the yarn as described in more detail later on.

Referring to FIG. 3, the yarn suction and cutting means 9, 10 consists of a cutting and sealing piston 20 which is axially movable but secured against rotation within a housing 21 and held by a spring 22 in an upper suction and readiness position for cutting. The upper part of the piston 20 is provided with a recess 23 or suction opening which merges into a central bore 24 extending vertically downwards into the exhaust duct 8. A vacuum is supplied to the recess 23 via the bore 24 by the exhaust duct 8. In addition, a rotatably arranged switching sleeve 25 is mounted between two rings 26, 27 with grooves 28, 29, 30 (shown enlarged and in the developed state) being arranged in the outer surface of sleeve 25 into which a pin 31, mounted in the housing 21, protruces. If the piston 20 is depressed down from an upper suction position, as shown in FIG. 3, the sleeve 25 moves down with the piston 20 and is guided by the pin 31 protruding into the groove 28. The pin 31 thus moves, relative to the sleeve 25, up from the position Z causing the sleeve 25 to be rotated until the pin 31 reaches the position X. In this manner, the recess 23 is sealed by being retracted within housing 21 and the suction air stream is interrupted. Thus, the piston 20 and housing 21 by being mounted in the path of the holder 11 serve as a means for terminating the suction on a held yarn upon movement of the holder towards the operating position.

If the pressure on the piston 20 is released, the piston 20 including the sleeve 25 move up until the pin 31 reaches a rest position Y, i.e. the piston 20 remains still inside the housing 21 so that the recess 23 remains sealed and the suction action thus remains ineffective. If a downward pressure is applied again on the piston 20, the pin 31 reaches via the groove 29, as the sleeve 25 rotates further, and remains in a relative position Z′ for a short time. As the pressure is subsequently released, the piston 20 and the sleeve 25, guided by the groove 30, move up fully, the pin 31 moving, relative to the sleeve 25, down in the groove 30 and reaches position Z again. The sleeve 25 then again is in its initial position indicated in FIG. 3. Thus, upon a first application and release of pressure the piston 20 does not move up so far that the recess 23 is unsealed. Only upon a second application and release does the piston 20 move up fully.

As shown in FIG. 3, the cutting or severing means 70 is formed by a cutting edge 32 on the upper edge of the housing 21 and a cutting edge 33 about the suction opening 23 of the piston 20.

In operation, if the bobbin 5 is full, or if its desired diameter is reached, the bobbin 5 on the holder 11 is lifted off the friction drive drum 6 by hand into an upper idling position and is held there by a catching device (not shown) as indicated with dash-dotted lines in FIG. 1. The yarn is then lifted off the traversing thread guide 16 and placed in the notch 18 of the yarn guide plate 17. The bobbin 5 is then taken off by detaching the bobbin tube 14 from the holder 11 and is deposited on the machine, e.g. on a transporting belt, or any other place. The yarn extending to the full bobbin is then brought by hand to the suction means 9 after the piston 20 has been pushed downwardly by an operator. The yarn is then sucked into the opening 23 so that a loop of yarn is formed within the piston 20. Subsequently, an empty tube 14 is placed into the holder 11. Owing to the lateral distance *a* of the suction means 9 from the regular yarn winding zone H, the yarn extends outside the yarn winding H about at a distance *a.* The yarn also extends in a path from the notch 18 to the suction means 9. This yarn path also coincides with the region of the adhesive reserve winding zone 19 on the tube 14 and the piston 20 is arranged exactly in the pivoting zone of the plate 15 which pivots together with the holder 11.

Next, the holder 11 with the empty tube 14 thereon is pivoted downward until the plate 15 first contacts the piston 20. As the holder 11 pivots further, the piston 20 is lowered so far that the suction recess 23 disappears and is sealed by the housing 21; the piston 20 reaching its lowest position (FIG. 1) as the holder 11 reaches its lowest operating position. The yarn which is under very low tension due to the suction force is thus reliably severed in close vicinity to the contacting line of the tube 14 by the scissor action of the knife-edged upper cutting edge 32 of the housing 21 and the edge 33 on the piston 20. The short yarn end which results is brought into contact with the adhesive zone 19 of the tube 14 at the very moment in which the tube 14 contacts the friction drive drum 6 and starts rotating. Thus, the extremely short yarn end is taken up and held by the zone 19 at the side of the tube 14 and by the following revolutions, yarn reserve windings 34 are formed to cover the free yarn end. As a next step, the yarn is placed into the traversing thread guide 16, and the regular bobbin package build is started over the yarn winding zone H. Once the bobbin has reached a desired diameter, the bobbin change process is initiated anew.

In the method described above, the steps of suction, severing and taking up the yarn end on the tube are automated, and the other steps are effected manually by the operator. These processes by themselves, however, are decisive for simple operation and for reliably forming yarn reserve windings that can be used effectively. There are, however, possibilities of further automating the procedure if desired and if increased expenditure is justified.

Figure 5:
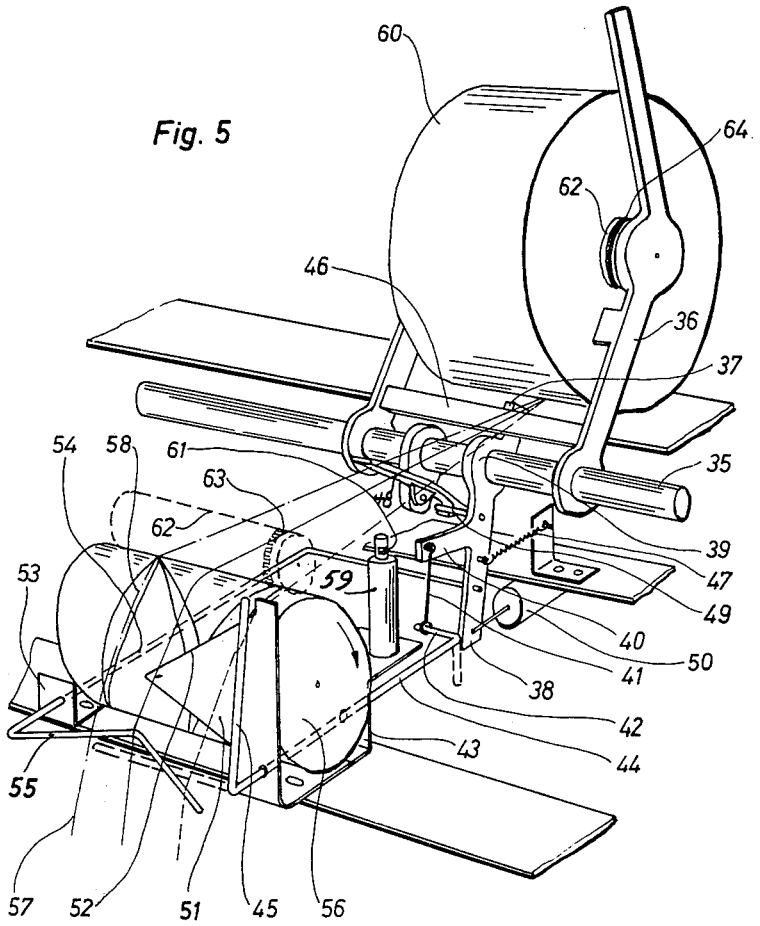
FIG. 5 illustrates an axonometric view of an alternative apparatus of the invention.

For example, referring to FIG. 5, the yarn can be also lifted off the traversing device (not shown) and laterally moved into the region of the adhesive zone of the bobbin tube automatically as the bobbin is lifted. Furthermore, the yarn can be brought back into the traversing guide automatically, as the empty bobbin tube is brought into contact with the friction drive drum. To this end, the apparatus includes a pivoting axle 35 on which a bobbin holder 36 is mounted along with a freely pivotable lever 39 consisting of two arms 37 and 38. One arm 38 is provided with an extension 40 to which a connecting member 41 is linked at one end with the other end linked to an angled end 42 of a rod 44 rotatably arranged in a support 43. The front end of the rod 44 carries a yarn guide member 45 which is pivotal clockwise from a horizontal position, indicated by broken lines, by somewhat more than 90°, to an approximately vertical rest position. The rod 44 is activated by the upward pivoting motion of the bobbin holder 36 as the arm 37 contacts a transverse member 46 of the holder 36. A tension spring 47 also acts on the arm 38 to effect a setting back of the lever 39 as soon as the transverse member 46 releases a ratchet 48 from a pin 49 mounted on the arm 38 as the holder 36 is pivoted down. This occurs at the moment in which the tube contacts the friction drive drum 56. In addition, a dampening device 50 is provided for the lever 39 while a yarn guide plate 51 is fixed to the support 43 behind the yarn guide member 45 in its vertical position. This plate 51 has an inclined yarn guide edge 52 which extends towards the inside.

A mechanism for automatically taking yarn off the yarn traversing means (not shown) i.e. yarn guide, is connected to the bobbin holder for actuation by the holder upon pivoting of the holder toward the idling position. This mechanism includes a rod 54 mounted in the arm 38 in a bracket 53 on the support 43 towards the front. The rod 54 has a curved front part 55 which in an idling position is outside the regular yarn path slightly below a traversing and drive drum 56.

In operation, as the bobbin holder 36 is pivoted up, the rod 54 slides forward owing to the pivoting motion of the lever 39 and lifts the yarn 57 (the position of which is indicated with dash-dotted lines in FIG. 5) off grooves 58 in the traversing and drive drum 56 into the position indicated with solid lines in which position the yarn guide member 45 can easily take up the yarn. As above, a suction and cutting means 59 is arranged behind the traversing and drive drum 56 in analogous manner.

In this embodiment, once a bobbin 60 is full, the holder 36 is pivoted up until the traverse member 46 pivots the lever 39 and the rod 54 lifts the yarn off the groove 58, i.e. off the traversing device. Simultaneously, the yarn is taken up by the yarn guide element 45 pivoting into the vertical position and is pushed along the guide edge 52 towards the outside and upwards until the lever 39 comes to rest in the end position. The yarn then has reached the position indicated with broken lines in FIG. 5. The full bobbin 60 is now detached by hand from the holder 36 and the yarn is brought to the suction opening 61 of the suction means 59. Then, a fresh empty tube 62 is placed into the holder 36 and the holder 36 is lowered again. The yarn delivered into the suction opening 61, forming a loop in the bore 24 or in the exhaust duct 8, is severed shortly before the holder 36 reaches the operating position again by the cutting means (not shown in detail) which is combined with the suction means 59 in close vicinity of the empty tube 62 or of the traversing and drive drum 56, respectively. The free end of the continuously supplied yarn is thus immediately taken up by an adhesive zone 63 of the tube 62 and the formation of yarn reserve windings is effected. In the meantime, the yarn guide member 45 and the rod 54 return into their idling position under the influence of the spring 47 and of the dampening device 50. As the yarn is now no longer held by the suction means 59 in the lateral position corresponding to the adhesive zone 63 of the tube 62, the yarn tends to move back upon formation of a few reserve windings towards the middle part of the bobbin tube 62 on the guide edge 52 and to be caught in the traversing groove 58 again, whereupon the regular winding process is resumed.

The yarn reserve windings 64 formed on the tube 62 at the beginning of a bobbin package building process are shown on the full bobbin 60 in the lifted-off position.

In case the tube has no adhesive zone for taking up the yarn, the apparatus can be constructed to accommodate such a tube. For example, referring to FIG. 6, wherein like reference characters indicate like parts as above, a clamping means such as a disc 67 is slidably supported on the left side arm 65 of a bobbin holder along with a plate 66 for activating the suction and cutting means 59. This disc 67 is brought, or held respectively, in a clamping position with the tube 70 by a lever 68 and a compression spring 69 mounted on the arm 65. The lever 68 is held in a non-clamping position by a retaining device 71.

As shown, when a tube 70 is being donned, the yarn extends from the yarn guide member 45 and the guide edge 52 between the disc 67 and the face side of the tube 70 and is held in readiness position by hand. After the arm 65 is lowered, the retaining device 71 is released by hand and the disc 67 contacts the face side of the tube 70 (position indicated with broken lines) so that the tube 70 is clamped. The yarn is immediately clamped and, at the same time, is shifted by a rod 72 moving together with the disc 67 into the position in which the reserve windings are to be formed on the tube 70. The short yarn end severed by the suction and cutting means 59 while the arm 65 is brought into the operating position is thus held between the face side of the tube 70, where the yarn is clamped, and the position of the reserve windings as determined by the rod 72.

Alternatively, referring to FIG. 7, where a tube without an adhesive zone is used, the bobbin holder can consist of two coupled arms 73, 74 known as such which tend towards each other in spring-like fashion. These arms 73, 74 are adaptted to manually receive an empty bobbin tube 70 and are pressed apart so far that the arm 74 with a cam 77 contacts a piston 75 of a suction and cutting means 76 (FIG. 8). At the same time, the arm 74 is supported by a support 78 rigidly connected to the machine frame so that the arm 74 cannot reach its lowest position. Furthermore, a lever 79 is pivotably mounted on the arm 74 to one side while a member 80 is pivotally connected on the outer side of the arm 74 in such a manner that the end of te member 80 is inserted into a slot 81 (FIG. 8) of the piston 75 when the arm 74 contacts the support 78 and the cam 77 laterally contacts the piston 75. As shown, the member 80 is pivotally connected to the lever 79 which passes through the arm 74. The inside of the arms 73, 74 are equipped with rotatably supported discs 82 for taking up the tube 70.

As shown in FIG. 7, during donning, the yarn extending to the full bobbin passes along the yarn guide member 45 which is pivoted into its upright position and along the yarn guide edge 52 to the yarn suction opening 83 (FIG. 8) at the side of the manually held tube 70 to be placed into the holder (compare FIG. 7) and at a height corresponding to the face side of the tube 70, or the discs 82, respectively, while the arm 74 is still supported. If now the lever 79 is pressed down, the piston 75 is activated by the member 80 and lowered so that the yarn is cut. At the same time, the arm 74 is also released for horizontal movement towards the inside (i.e. the lowering of the piston 75 below the cam 77 allows the arm 74 to move to the left as viewed) and the tube 70 is clamped between the discs 82. The yarn positioned between the disc 82 and face side of the tube 70 is thus clamped. As the clamping action is effected, the arm 74 drops from the support 78 into the position indicated with broken lines in FIG. 8 and the empty tube 70 thus contacts the friction drive drum 56 arranged below. At the same moment, a reserve rod 80 (FIG. 7) shifts the yarn onto the tube 70 up to the zone of the reserve windings where the reserve windings are now formed, the short free end of the yarn being bound in the process. The yarn guide element 45 is pivoted back into the idling position as the retaining device 48 (FIG. 5) is released at the moment in which the tube 70 contacts the drive drum 56, whereupon the regular traversing motion is resumed.

Figure 10:
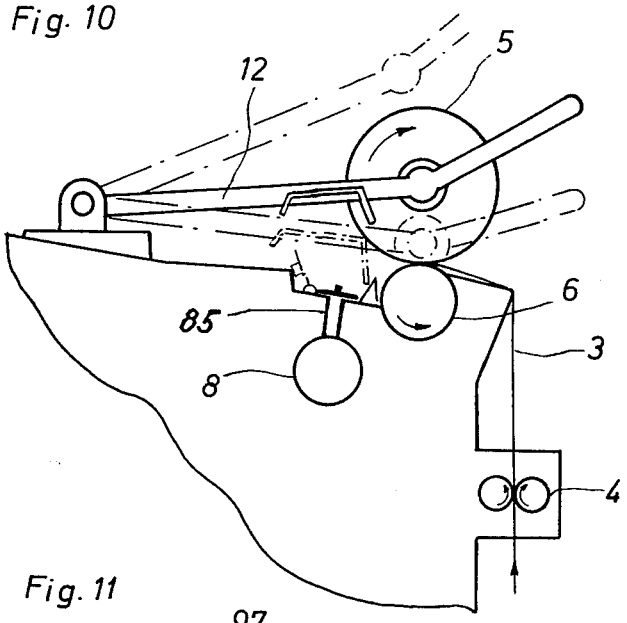
FIG. 10 illustrates a schematic side view of a winding device of an open-end spinning machine utilizing a yarn clamping means in accordance with the invention.

Referring to FIG. 10, wherein like reference characters indicate like parts as above, the spinning machine for staple fibers delivers yarn 3 from the spinning device by a pair of take-off rolls 4 and winds the yarn onto a bobbin tube 14 which in its operating position contacts a friction drive drum 6 and is frictionally driven so as to rotate. A sealable suction means 85 is positioned downstream of the drive drum 6 relative to the supplied yarn 3 for holding the yarn 3 under suction at a first position. To this end, the suction means 85 has an orifice located immediately behind and in alignment with an adhesive zone 19 (FIG. 12) on the bobbin tube 14. The suction means 85 also has a pivotally mounted cover 88 attached to a cover plate 87 (FIG. 11) of the spinning machine for selectively opening and closing the orifice. Also, the suction means 85 has a notch 86 in communication with the orifice, i.e. adjoining the orifice, and which is disposed in a position outside the cover 88 when the cover 88 closes the orifice and on the side facing the bobbin tube 14. Thus, a small suction duct is formed by the notch 86 and the cover 88 which always remains open. In order to seal the suction orifice, the underside of the cover 88 is provided with an elastic layer 89. A rubber bumper 90 is also mounted on the upper side of the cover 88 to support the cover 88 in an opened state on the cover plate 87. The elastic layer 89 and the rubber bumper 90 can also be formed in one piece; the bumper 90 protruding through and being held in place by an opening provided in the cover 88.

Figure 11:
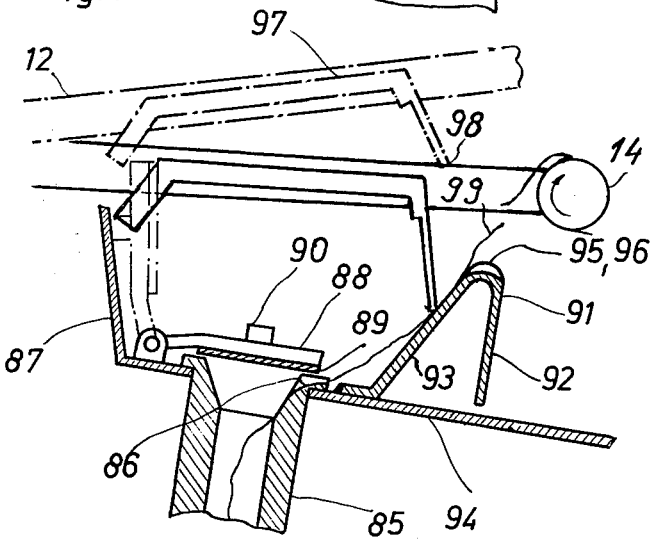
FIG. 11 illustrates an enlarged view of the yarn suction and clamping means of FIG. 10.
Figure 12:
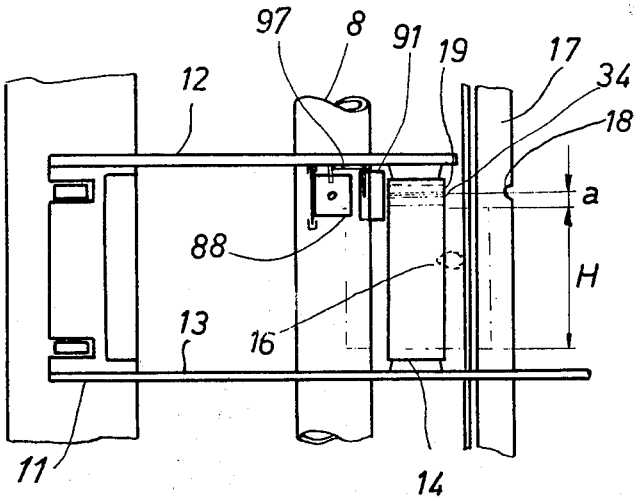
FIG. 12 illustrates a top view of a winding position of the machine of FIG. 10.

Referring to FIGS. 10 and 11, a means is mounted on the holder 11 for selectively clamping the yarn 3 in a second position between the suction device and the bobbin tube 14 with the holder 11 in the operating position. This means includes a two-legged yarn guide plate 91 having one leg 93 mounted onto a cover plate 94 of the spinning machine to secure the plate 91 in a stationary position and a depending leg 92. The yarn guide plate 91 has a crest or bent portion for passage of the yarn 3 and a notch 95 in the crest which guides the yarn 3 in a predetermined path in the middle of the guide plate 91. In addition, the means includes a clamping plate 97 which is mounted on the holder 11. As shown, the plate 97 is secured on an arm 12, which together with an arm 13 supports the bobbin tube 5. The plate 97 is adjustably arranged in such manner that its position on the arm 12 can be adapted to the diameter of the bobbin tubes 14 used. On the right hand side, the plate 97 is provided with an elastic leg with a lower longitudinal edge 98 extending parallel and opposite to the leg surface 93 of the yarn guide plate 91 to selectively abut the plate 91 to clamp the yarn 3 therebetween. The plate 97 is dimensioned to selectively abut and be pressed against the guide plate 91 as the holder 11 is lowered completely.

In order to maintain sufficient contact pressure between the lower edge 98 of the clamping plate 97 and the leg surface 93 of the guide plate 91, even if the diameters of the bobbin tubes 14 vary slightly, the yarn guide plate 91 is elastically yieldable. Instead of, or in addition to, the yarn guide plate 91 also the cover plate 94 can be elastically yieldable. on the left hand side, the plate 97 is provided with a leg member, the inclined position of which causes the cover 88 of the suction means to be closed as the holder 12 is lowered. That is, the cover 88, when opened, is disposed in the path of the plate 97 on the holder 11 to be moved into the closed position.

The apparatus is operated as follows:

If the bobbin package 5 is completed or, respectively has reached the desired diameter (FIG. 10) the bobbin package 5 is lifted off the friction drive roll 6 by lifting the handle on the holder 11 and the holder 11 is held in the lifted position (indicated with dash-dotted lines in the upper position in FIG. 10) by a stop mechanism (not shown). After the yarn has been manually lifted off a traversing thread guide 16 and has been placed into a notch 18 of a thread guide plate 17, the bobbin package 5 is then doffed by unclamping the bobbin tube 14 from the holder 11 and deposited on the machine, e.g. on a transporting belt, or elsewhere. After manual opening of the cover 88, the yarn which trails off from the full bobbin package is then brought to the suction means 85 by hand in such manner that a growing loop is formed in the suction means 85 which loop is sucked in. The yarn extending from the suction means to the deposited full bobbin package then is severed by hand and the bobbin package 5 can be transported off.

Subsequently, an empty bobbin tube 14 is clamped into the holder 11 which is still in the idling position. The lateral distance *a* to the suction means 85 ensures that the yarn extends laterally outside the regular yarn traversing zone H about at a distance *a* from the notch 18 through the notch 95 in the guide plate 91 towards the suction means 85.

The holder 11, into which the empty bobbin tube 14 is clamped, is again pivoted down. In this step, the angled back end of the plate 97 closes the cover 88 and the plate 97 contacts the leg surface 93 of the guide plate 91. Due to the clamping action of the lower edge 98 of the clamping plate 97 and the leg surface 93, the yarn feebly tensioned by the action of the suction means 85 is clamped in very close vicinity to the contacting point of the bobbin tube 14 and the advancing free yarn loop is brought into contact with the adhesive zone 19 of the bobbin tube 14 at the moment at which the bobbin tube 14 starts rotating under the influence of the friction drive drum 6. If the yarn loop has formed a sufficient wrap angle on the bobbin tube 14, the yarn between the bobbin tube 14 and the clampaing point is ruptured. The subsequently formed warps create a yarn reserve which covers the short free yarn end.

In a next step, the yarn is placed manually into the thread traversing guide 16 and the regular bobbin package build over the lift H can be started. As the bobbin package diameter increases, the lower edge 98 again moves away from the guide plate 91. Thus, the yarn portion clamped there is freed and is sucked off via the suction duct formed by the notch 86 and the cover 88. The clamped yarn portion can also be sucked off immediately, however, if the holder 11 is lifted for a short time after the yarn is placed onto the new bobbin tube. As soon as bobbin package has reached a desired diameter, the bobbin change process is started again.

This above embodiment not only forms the yarn wrap reserve or reserve windings desired for the further processing of the bobbin package but also, as the yarn is ruptured in very close vicinity to the winding point, prevents the short yarn end which is generated from extending from the adhesive zone 19 of the bobbin tube 14 out of the yarn wrap reserve into the regular thread traversing zone 14 where the end could be bound in by the regular package build. Thus, the yarn wrap reserve 34 can be subsequently taken off the bobbin tube 14 easily and the process of piecing the end to the subsequent bobbin package in the next processing step can be shortened.

In the apparatus described above the processes of suction, of clamping and of thread catching on the bobbin tube are automated, while the other manipulations are effected manually by the operator. The abovementioned processes, however, in themselves are decisive for easy operation and for reliably generating a suitable yarn wrap reserve or reserve windings. There are, however, possibilities of further automating the apparatus if desired and if a more complicated and expensive construction is justified.

The term "short yarn end" used in the above description to describe the end of the yarn cut by the cutting means is understood to designate a yarn end of a length corresponding to about half the circumference or shorter of the fresh tube in the bobbin holders.

The formation of yarn reserve windings according to the invention is advantageous insofar as the method can be applied by untrained operators without disturbances insofar as the apparatus, due to its simplicity, can also be operated and maintained by untrained operators without disturbances. Since the reserve windings are always formed at the same bobbin side, no difficulties are encountered in further processing. For example, in creeling the bobbins, the reserve winding can be presented at all processing positions in the same manner. Thus, during unwinding of the yarn, balloons of adjacent bobbins all rotate in the same direction desired, namely in the direction for which the yarn guide elements are laid out.

Primarily, the short yarn end allows the achievement of great reliability in the subsequent processing of the yarn. Also, as far as tube quality is concerned, only minimal requirements are needed.

The method of forming yarn reserve windings as described is also feasible at the most diverse yarn winding tenlevels, as e.g. required for weft yarns to be woven on shuttle-less weaving machines, on one hand, and for drying bobbin packages on the other hand. Application of the inventive method is very flexible since it can be carried out whether the bobbin change is effected by hand or fully automatically. As the method permits fast operation, the amount of waste yarn produced is low and also the consumption of suction air for eliminating the yarn loop is insignificant.

What is claimed is:

1. A method of forming reserve windings during a bobbin change on a spinning machine wherein a wound bobbin is removed from the machine and an empty tube is placed in the machine comprising the steps of lifting the wound bobbin from an operating position to an idling position for making a bobbin change;

continuously supplying yarn from a spinning device during said bobbin change;

displacing the continuously supplied yarn transversely of the wound bobbin into a reserve winding path;

holding the displaced yarn under a suction force at a first position while doffing the wound bobbin and thereafter donning the empty tube;

lowering the empty tube into said operating position while simultaneously clamping the yarn at a second position upstream of said first position;

thereafter winding the yarn for a plurality of reserve windings onto the empty tube in a reserve winding zone to impart a sufficient tension in the yarn between said second position and the tube to rupture the yarn therebetween and to form a short yarn end for winding into the reserve windings; and thereafter moving the supplied yarn from said reserve winding zone transversely of the tube into a yarn winding zone of the tube spaced laterally from the reserve winding zone to build a bobbin.

2. A method as set forth in claim 1 which further comprises the step of unclamping the ruptured yarn at said second position in response to a subsequent lifting of the tube.

3. An apparatus for forming reserve windings comprising a holder for removably receiving a tube for winding of a bobbin thereon, said holder being pivotally mounted between an operating position and an idling position above said operating position;

a friction drive drum mounted adjacent said operating position for driving a tube removably mounted in said holder;

a spinning device for supplying a yarn between said friction drive drum and said holder;

a yarn suction means positioned downstream of said friction drive drum relative to the supplied yarn for holding the yarn under suction, said suction means being positioned below said holder and including means in the path of said holder for terminating the suction of said suction means on a held yarn movement of said holder towards said operating position; and a yarn severing means positioned downstream of said friction drive drum relative to the supplied yarn for severing a yarn held under suction in said yarn suction means to produce a short yarn end, said yarn severing means being positioned below and in the plane of said holder and including means in the path of the holder for actuating said yarn severing means upon movement of said holder towards said operating position to sever a yarn.

4. An apparatus as set forth in claim 3 wherein said suction means includes a housing, a piston slidably mounted in said housing and including a suction opening therein for receiving a yarn, and a spring in said housing for biasing said piston out of said housing to expose said suction opening.

5. An apparatus as set forth in claim 4 wherein said severing means includes a first cutting edge on said housing and a second cutting edge on said piston, said cutting edges being positioned to sever a yarn upon movement of said piston into said housing to seal said suction opening.

6. An apparatus as set forth in claim 5 wherein said second cutting edge is disposed about said suction opening and said cutting edge is positioned at an end of said housing.

7. An apparatus as set forth in claim 3 wherein said holder includes a cam for pressing said piston into said housing against said spring upon movement of said holder from said idling position to said operating position.

8. An apparatus as set forth in claim 7 wherein said piston is manually operable with said holder in said idling position.

9. An apparatus as set forth in claim 8 wherein said piston is movable between an upper position to receive a yarn, a retracted position to seal said suction opening, and an intermediate rest position with said suction opening within said housing.

10. An apparatus as set forth in claim 3 wherein said suction means includes a suction opening for receiving a yarn and said severing means has an edge for sealing said suction opening upon movement of said holder towards said operating position.

11. An apparatus as set forth in claim 3 wherein said suction means remains in a rest position during an upward pivoting movement of said holder in said operating position.

12. An apparatus as set forth in claim 3 wherein said severing means remains closed during an upward pivoting movement of said holder in said operating position and is opened upon pivoting of said holder into said idling position.

13. An apparatus as set forth in claim 3 further comprising a yarn traversing means for moving the yarn laterally of said holder to wind a bobbin on a tube mounted in said holder, and a mechanism connected to said holder for actuation upon pivoting of said holder toward said idling position for taking the yarn off said yarn traversing means prior to said holder reaching said idling position.

14. An apparatus as set forth in claim 13 wherein said mechanism is movable into an idle position upon movement of said holder from said idling position thereof towards said operating position.

15. An apparatus as set forth in claim 14 which further includes a guide means connected to said holder for guiding a yarn taken off said traversing means into a reserve winding zone spaced from said traversing means.

16. An apparatus as set forth in claim 15 wherein said guide means is movable into an idle position upon movement of said holder from said idling position thereof towards said operating position.

17. An apparatus for forming reserve windings comprising a holder for removably receiving a tube for winding of a bobbin thereon, said holder being pivotally mounted between an operating position and an idling position above said operating position;

a friction drive drum mounted adjacent said operating position for driving a tube removably mounted in said holder;

a spinning device for supplying a yarn between said friction drive drum and said holder;

a yarn suction means positioned downstream of said friction drive drum relative to the supplied yarn for holding the yarn under suction at a first position; and means mounted on said holder for selectively clamping the yarn in a second position between said first position and a tube on said holder with said holder in said operating position.

18. An apparatus as set forth in claim 17 wherein said means for clamping includes a yarn guide plate mounted in a stationary position on the machine and a clamping plate mounted on said holder opposite said guide plate to selectively abut said guide plate to clamp the yarn therebetween.

19. An apparatus as set forth in claim 18 wherein said yarn guide plate has a crest for passage of the yarn thereover and a notch in said crest for guiding the yarn in a predetermined path.

20. An apparatus as set forth in claim 18 wherein one of said yarn guide plate and said clamping plate is elastically yieldable.

21. An apparatus as set forth in claim 18 wherein each of said yarn guide plate and said clamping plate is elastically yieldable.

22. An apparatus as set forth in claim 18 wherein said clamping plate is adjustably mounted on said holder.

23. An apparatus as set forth in claim 17 wherein said yarn suction means includes an orifice at said first position to receive a yarn therein, said orifice being positioned immediately behind said second position.

24. An apparatus as set forth in claim 23 wherein said yarn suction means includes a cover for selectively opening and closing said orifice, said cover being disposed in the path of said means on said holder to move into a position closing said orifice upon movement of said holder to said operating positon.

25. An apparatus as set forth in claim 23 wherein said yarn suction means further includes a notch in communication with said orifice and disposed in a position outside said cover when said cover closes said orifice.

* * * * *

UNITED STATES PATENT AND TRADEMARK OFFICE

CERTIFICATE OF CORRECTION

PATENT NO. : 3,942,731

DATED : March 9, 1976

INVENTOR(S) : Andre Lattion

It is certified that error appears in the above-identified patent and that said Letters Patent are hereby corrected as shown below:

In the Abstract, line 3, delete "a" and insert --an--.

Column 4, line 50, delete "saem" and insert --same--.

Column 5, line 6, delete "protruces" and insert --protrudes--.

Column 6, line 62, after "taking" insert --the--.

Column 8, line 16, delete "adaptted" and insert --adapted--.

Column 14 (claim 24), line 36, delete "positon" and insert --position--.

Signed and Sealed this

Thirteenth Day of July 1976

[SEAL]

*Attest:*

RUTH C. MASON
*Attesting Officer*

C. MARSHALL DANN
*Commissioner of Patents and Trademarks*